United States Patent [19]

Hall, Jr.

[11] 4,008,500

[45] Feb. 22, 1977

[54] FISHING BOAT PLATFORM

[76] Inventor: Clarence Addison Hall, Jr., P.O. Box 676, Belzoni, Miss. 39038

[22] Filed: Sept. 2, 1975

[21] Appl. No.: 609,824

[52] U.S. Cl. ..... 9/7; 115/18 E; 297/217; 297/349

[51] Int. Cl.[2] ..... B63B 29/00

[58] Field of Search ..... 9/7; 114/153, 144 R, 114/144 E; 115/18 E, 25, 18 R; 74/512; 180/77 R, 77 S; 182/2; 244/83 E, 86; 297/69, 217, 330, 349, 429

[56] References Cited

UNITED STATES PATENTS

| | | | |
|---|---|---|---|
| 3,039,553 | 6/1962 | VanDerLely et al. | 180/77 S |
| 3,151,910 | 10/1964 | Larson | 297/349 |
| 3,528,304 | 9/1970 | Hopkins | 182/2 |
| 3,542,424 | 11/1970 | Bingley et al. | 297/349 |
| 3,598,947 | 8/1971 | Osborn | 115/18 R |

*Primary Examiner*—Trygve M. Blix
*Assistant Examiner*—Charles E. Frankfort
*Attorney, Agent, or Firm*—Lowe, King, Price & Markva

[57] ABSTRACT

A rotatable platform is provided to support the chair of a bass fishing boat. The platform has the chair rotatably mounted at one end and includes a boat rest for positioning the feet of the fisherman at the other. The feet positioning end preferably includes a wedge-shaped footrest for one foot of the fisherman, adjacent to which is mounted a foot actuated control pedal and, in the preferred embodiment, the pedal controls electric trolling motor.

The entire platform is mounted on a pedestal fastened securely to the deck of the fishing boat. In one embodiment, the platform is rotatable about the pedestal by means of an electric motor and gear arrangement. The controls for the motor are preferably located on the wedge-shaped footrest of the platform such that they also may be foot actuated. The chair is rotatably mounted to the same housing that contains the electric motor and gearbox. While the platform is rotatable via the gearbox, the chair may be rotated independently of the platform if desired. The footrest portion of the platform also functions as a convenient mount for various fishing instruments, such as a depth finder, which will therefore always be easily seen by the fisherman.

18 Claims, 4 Drawing Figures

FISHING BOAT PLATFORM

BACKGROUND OF THE INVENTION

1. Field of the Invention

The present invention is related to fishing boat chairs and control instruments and, more particularly, is directed toward a platform utilized in combination with the chair and control instruments of a bass fishing boat.

2. Description of the Prior Art

Fishing boats are frequently provided with a chair which is either secured to the deck or rotatable about a fixed pedestal. The fisherman sits in the chair for comfort, support and leverage while fishing. The chair may be turned to one side of the boat or the other, depending upon the particular fishing area of interest.

Many modern fishing boats are also provided with electric fishing motors for trolling and the like. Such motors are commonly provided with a control device in the form of a foot pedal in order to obviate the necessity for manual control of the electric motor while fishing. While such electric motors have been found to be extremely popular as a result of their low noise level, use of the foot pedal control is rather inconvenient. If the control is not fastened to a part of the boat, it may not be readily accessible when needed and may be easily turned over and accidentally actuated. If, on the other hand, the foot pedal control is fastened in one position to the bottom of the boat, it obviously becomes difficult to use by anyone who is not immediately adjacent the place where it is fastened.

For example, if the foot pedal control is mounted to the center deck of a boat, adjacent a standard fishing chair, as the fisherman turns to starboard to fish from that side of the boat, the foot pedal may wind up in a position where the fisherman is forced to operate it with his left foot, which can be extremely inconvenient and uncomfortable to a right-footed person. On the other hand, as the fisherman turns his chair to the port side of the boat for fishing, he may at times be required to extend his right leg at a rather sharp angle in order to operate the foot pedal. This quite naturally becomes extremely tiresome within a short period of time.

Further, in such fishing boats, it is generally necessary to provide a foot rest or surface against which a fisherman may brace himself at the time of "setting the hook" in a fish. For example, the Ottinger U.S. Pat. No. 2,757,630 describes a wedge-shaped platform which is utilized in conjunction with a clip-on fishing chair to steer an outboard motor. An adjustable vertical support member is provided for setting the height of the foot platform. The platform may be moved to different parts of the boat in order to allow the fisherman leeway to fish from various positions of the chair. However, the foot platform being detached from the chair, must be manually moved each time the chair is moved, an inconvenience in and of itself.

Modern fishing boats may also be equipped with sophisticated instrumentation, such as depth finders, whose indicator face should preferably be within clear view of the fisherman at all times. However, in view of the frequent changing of orientation of the fisherman, it becomes difficult, as in the case of the foot pedal control mentioned above, to maintain visual access to such instruments without unduly diverting one's attention.

I am also aware of the following U.S. Pat. Nos. 3,417,723; 3,151,910; 2,989,021; and 2,960,057. Each of the foregoing discloses a combination fishing chair-outboard motor control for a fishing boat. None of the foregoing, however, provides any ready solution to the disadvantages noted above with respect to the foot pedal control, the footrest or brace, special instrumentation placement, or the like.

OBJECTS OF THE INVENTION

It is therefore a primary object of the present invention to provide means utilizable in combination with a fishing chair and foot pedal control for a fishing boat which overcomes all of the disadvantages noted above.

Another object of the present invention is to provide a fishing boat chair in combination with an apparatus which renders the foot pedal control for an electric motor readily accessible to the fisherman at all times.

An additional object of the present invention is to provide an apparatus to be utilized in combination with a fishing chair on a boat which is easy to use, readily adaptable to existing boats, and affords a degree of convenience to a fisherman heretofore unrealized.

An additional object of the present invention is to provide a platform utilizable in conjunction with a fishing chair for a boat which may either be manually or automatically rotatable.

A still further object of the present invention is to provide a platform upon which a fishing chair is mounted, the platform and chair being independently rotatable in order to provide flexibility in use.

Another object of the present invention is to provide a platform utilized with a fishing boat chair which provides a means for mounting instrumentation which is always within easy view of the fisherman.

A still further object of the present invention is to provide a platform utilized in conjunction with a chair for a fishing boat which is adjustable as desired by the individual fisherman, and in which the chair may be readily removed for storage or transport.

SUMMARY OF THE INVENTION

In accordance with the present invention, a fishing boat platform comprises a substantially flat base member pivotable about an axis that is substantially perpendicular to a horizontal surface or deck of a fishing boat. The horizontal base member preferably includes an inclined wedge-shaped footrest and a pedal-actuated electrical control for a motor mounted at one end thereof. The other end of the platform has a fishing chair pivotally mounted therethrough such that the platform and chair move as a unit about the pivotal axis of the platform.

The platform is provided with motorized means for powered rotation of the platform about its axis. In the preferred embodiment, a control housing containing an electric motor and gearbox assembly is provided intermediate the platform base member and the chair mount. Control of the electric motor is preferably achieved by means of foot-actuated push button switches provided on the upper end of the inclined wedge-shaped footrest. The entire platform unit, which includes the chair, base member, feet positioning means, and control housing, is mounted on a cylindrically shaped pedestal. The platform unit rotates about the pedestal which is fixed to the deck of the boat.

The footrest portion of the platform provides a convenient means for attaching other fishing instruments of the kind which should always be within easy observation of the fisherman, such as depth-finder. Also, other control buttons may be provided on the footrest for connection to other electric motors. The chair of the unit is rotatable independently of the platform for quick shifting to any desired position.

BRIEF DESCRIPTION OF THE DRAWINGS

The foregoing and other objects, aspects, uses and advantages of the present invention will be more fully appreciated as the same becomes better understood when considered in connection with the following detailed description of the present invention when viewed in conjunction with the accompanying drawings, in which.

DETAILED DESCRIPTION OF THE PREFERRED EMBODIMENT

Figure 1:
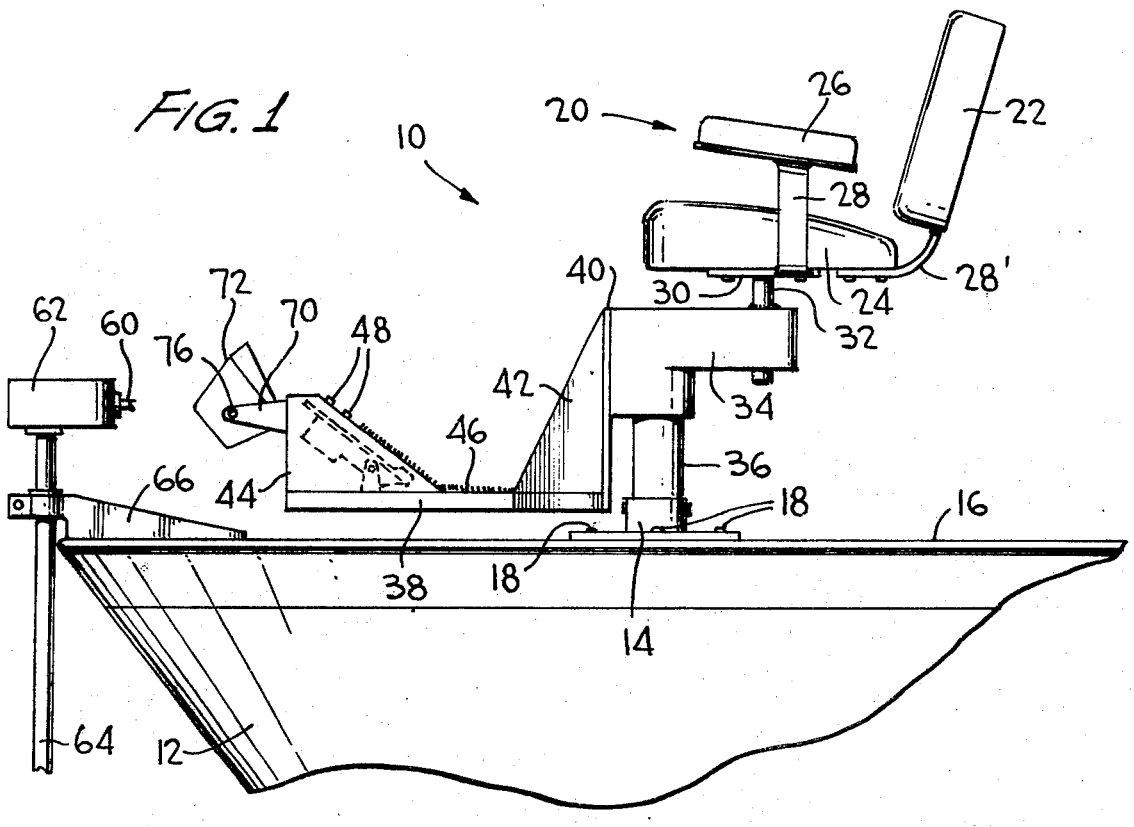
FIG. 1 is a side elevation of a preferred embodiment of the fishing boat platform mounted to the deck of a boat in accordance with the present invention.
Figure 2:
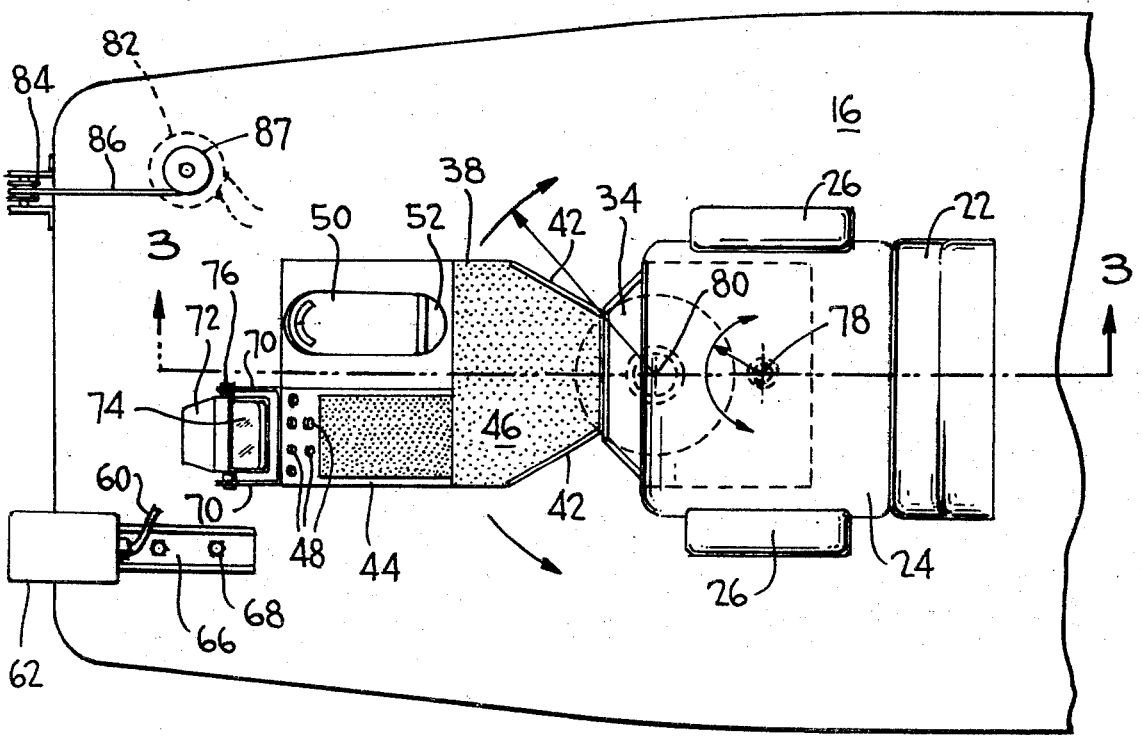
FIG. 2 is a top view of the preferred embodiment platform of FIG. 1.

Referring to FIGS. 1 and 2, platform 10, in accordance with the invention, is mounted on a substantially horizontal surface or deck 16 of a bass fishing boat 12 by means of a mounting base 14 secured to deck 16 by a plurality of bolts 18. Fishing chair 20, supported by platform 10, includes a backrest 22, a seat 24, a pair of armrests 26, and connecting frame members 28 and 28'.

Attached to the underside of seat 24 is a support plate 30. Connected firmly to support plate 30 near the center of seat 24 and extending downwardly therefrom is a pivot post 32 which extends through a support sleeve 88 (FIG. 3) formed in a control housing 34 of platform 10.

Figure 3:
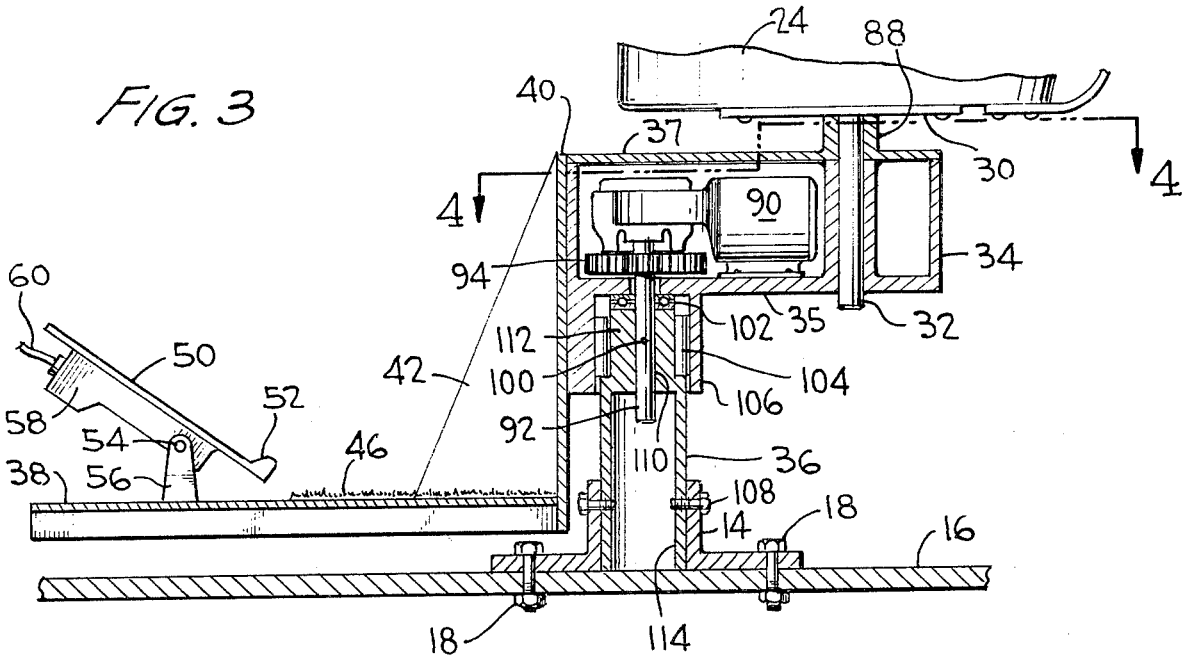
FIG. 3 is a sectional side view illustrating structural detail of the preferred embodiment of the present invention taken along line 3—3 of FIG. 2.

Control housing 34 is preferably rotatably mounted upon a platform pedestal 36 which is, in turn, secured within mounting base 14 by means of bolts 108 (FIG. 3). Attached to the frontal portion of control housing 34 and extending downwardly therefrom is a vertically oriented flat support plate 40.

Platform 10 further includes a substantially horizontal base member 38 which extends forward from the bottom portion of vertical plate 40. A pair of triangular side support gussets 42 have their respective edges connected to vertical plate 40 and base member 38 in order to lend structural strength to the platform.

Wedge-shaped footrest 44 and foot pedal control 50 for supporting the fisherman's feet are located at the distal end of base 38. As shown in FIGS. 1 and 2, the footrest 44 and foot pedal 50 are positioned for a right-footed person, although it is understood that the respective positions thereof on base member 38 may be reversed for the left-footed persons, without departing from the scope of the present invention.

Wedge-shaped footrest 44 is inclined with respect to base member 38 at substantially the same angle as foot pedal 50 for the comfort of the user. Footrest 44 not only provides a comfortable resting place for the left foot of the fisherman, but also provides a convenient and readily available surface against which the fisherman may brace himself when hooking and landing a fish.

The uppermost portion of wedge-shaped footrest 44 is preferably provided with a number of push-button control switches 48 for a purpose to be described in more detail hereinafter. Further, the upper surfaces of base member 38 and footrest 44 are preferably covered with a slip-inhibiting material 46, which may comprise, for example, indoor-outdoor carpeting.

Referring to FIGS. 2 and 3, a foot pedal control 50 is located adjacent footrest 44 at the distal end of base 38 of platform 10 to control an electric trolling motor assembly 62. Foot pedal 50 includes a heel rest 52 and has its control circuitry and hardware mounted within an attached housing 58 on the underneath surface thereof. Extending from housing 58 are electrical wires and a Bowden cable assembly 60 for connection to the desired electrical motor. For direction control through the cable, pedal 50 is rotatable about a pivot pin 54 (FIG. 3) inserted through a pair of support brackets 56 which are, in turn, firmly attached to the horizontal base member 38 of platform 10.

Referring back to FIGS. 1 and 2, an electric trolling motor 62 is shown mounted in a conventional position on boat 12 by means of a mounting bracket 66 which is secured to deck 16 by mounting bolts 68. Trolling motor assembly 62 includes a mounting shaft 64 extending downwardly into the water. The motor assembly is connected to the input wire and cable assembly 60.

Footrest 44 also provides an extremely convenient means for mounting auxiliary fishing instrumentation, such as depth finder 72. Depth finder 72 serves as a fish locator and includes a meter or indicator face 74 which is, according to the present invention, always within easy sight of the fisherman sitting in chair 20. Depth finder 72 is mounted to footrest 44 by means of side support brackets 70, and is made rotatable for the best viewing position about horizontal pivot pins 76.

FIG. 2 illustrates at numeral 82 the dotted outline of an anchor winch motor, located beneath deck 16, which has a shaft 83 extending upwardly through deck 16. Disposed about shaft 83 is a spool 87 about which rope 86 is wound. In the usual fashion, an anchor is connected to the end of rope 86 and is placed in the water via a guide roller 84. The anchor winch motor 82 is exemplary of another type of an electric motor which may be made controllable by one or more push-button switches 48 located on footrest 44.

FIG. 2 also illustrates the rotational axis 78 about which chair 20 may be pivoted according to the desires of the user, and also shows the rotational axis 80 about which the entire platform 10 may be pivoted. In the powered rotation embodiment of platform 10 of the invention, rotational axes 78 and 80 do not coincide. However, it is readily apparent that if platform 10 is designed without provision for powered rotation, axes 78 and 80 may be coaxial.

Figure 4:
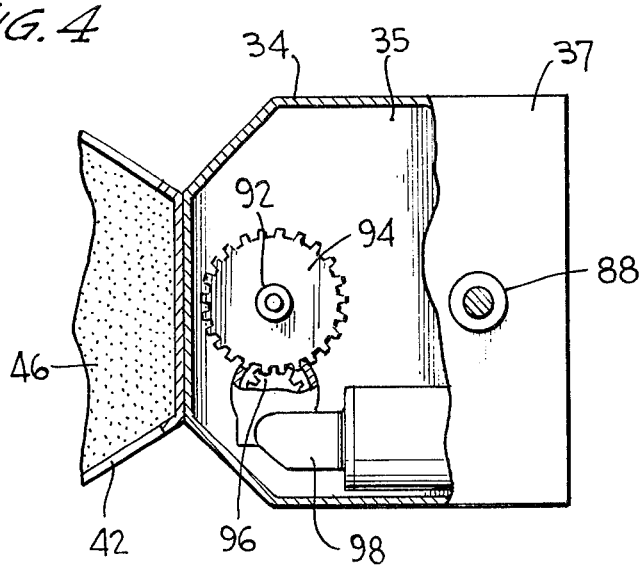
FIG. 4 is a top view illustrating an exemplary gearbox arrangement in accordance with a preferred embodiment of the present invention and taken along line 4—4 of FIG. 3.

Referring now to FIGS. 3 and 4, more detailed views of the automated rotational structure of the platform of the present invention is illustrated. Control housing 34 is shown in side section, and includes a baseplate 35 and a top plate 37. Extending downwardly from baseplate 35 is a housing sleeve 106. Housing sleeve 106 is sized to fit about the reduced diameter cylindrical bearing post 112 of pedestal 36. Housing sleeve 106 is freely rotatable about bearing post 112, roller bearings 104 being provided therebetween. A thrust bearing 102 is also provided about shaft 92 between bearing post 112 and baseplate 35.

Postioned within housing 34 is an electric motor 90. Electric motor 90 is preferably reversible and is controlled by a pair of buttons 48 on footrest 44 (FIG. 2).

Motor 90 has a housing 98 extending therefrom within which is a conventional motor driven worm gear (not shown). The worm gear within housing 98 drives a pinion gear 96 which, in turn, drives gear 94. Drive gear 94 has a driveshaft 92 connected at the center thereof, driveshaft 92 being coaxial with the axis of rotation 80 of platform 10.

As viewed in FIG. 3, a pin 100 is placed through coaxial apertures in bearing post 112 of pedestal 36 and driveshaft 92 in order to hold the latter stationary against rotation when the motor is activated. By virtue of pin 100, actuation of motor 90 causes the entire platform 10 to rotate about stationary gear 94 and shaft 92.

Pin 100 may be removed if it is desired that platform 10 be manually rotatable about pedestal 36. With pin 100 removed, shaft 92 will rotate freely within guide shaft 110 formed in cylindrical bearing post 112 of pedestral 36.

It is seen that by virtue of the foregoing the present invention provides a number of conveniences to the fishing boat fisherman heretofore unavailable. First, it may be observed that the foot pedal 50 for controlling the trolling motor 62 rotates with platform 10 and, hence, with the fisherman in chair 20 so as to be always readily accessible. In the same manner, footrest 44 is rotatable with the platform such that the fisherman has a ready surface against which pressure may be exerted at any moment.

The present invention also affords an opportunity for mounting one or more visual accessories, such as depth finder 72, directly to the platform such that the readings thereof may be readily observed at all times by a fisherman positioned in chair 20.

The provision of a selectively motorized platform also adds a touch of luxury and convenience heretofore unavailable. The controls for the rotatable platform in the form of foot actuated push-button switches 48 provide ease of operation without requiring the fisherman to divert his attention from the fishing task at hand. Push-buttons 48 may also provide means for controlling other electrical apparatus aboard the boat such as, for example, a motor lift, an anchor raising motor, or the like.

It should also be emphasized that the chair 20 is rotatable about pin 32 independently of the rotation of platform 10 about pedestal 36. In other words, if the fisherman suddenly observes a splash to one side of the boat, he may quickly turn chair 20 for a cast in that direction without having to rotate the entire platform 10. Also, chair 20 may be easily removed from housing 34 during the time that the boat 12 is being pulled on a trailer in order to lower the profile of the entire rig.

The platform unit may be made to be easily height-adjustable to suit an individual purchaser. To accomplish the foregoing, referring once more to FIG. 3, the cylindrical bottom portion 114 of pedestal 36 would be manufactured and delivered to the retailer in a fairly long length. The retailer may then cut bottom portion 114 to the height desired by the individual purchaser. The pedestal 36 would then be bolted in place by means of bolts 108.

Although not specifically illustrated, it is apparent that if the motorized rotation feature is not desired, post 32 and pedestal 36 could be combined into a single structure to simplify the construction of platform 10. In this manner, platform 10 would be rotatable about the pedestal of the chair and could be manufactured somewhat more cheaply than the motorized version.

Obviously, numerous modifications and variations of the present invention are possible in light of the above teachings. I therefore wish it to be understod that I do not desire to be limited to the exact details of construction shown and described.

What is claimed is:

1. A fishing boat platform, which comprises: platform means rotatably mounted with respect to a substantially flat surface of a boat; a chair rotatable with respect to said platform means; and feet placement means positioned near an end of and rotatable with said platform means, said platform means being rotatable about a platform axis that is substantially perpendicular to said flat surface of said boat, said platform means including a base member upon one end of which is mounted said feet placement means, said feet placement means including foot pedal means for controlling an outboard motor.

2. The fishing boat platform as set forth in claim 1 wherein said feet placement means includes a wedge-shaped footrest outwardly inclined with respect to said base member, said foot pedal means being mounted adjacent said footrest for controlling said outboard motor on said boat.

3. The fishing boat platform as set forth in claim 2 wherein said foot pedal means is pivotally mounted to said base member and includes electrical wiring extending therefrom to said electric outboard motor.

4. The fishing boat platform as set forth in claim 2 wherein said wedge-shaped footrest member comprises an inclined portion extending upwardly from said base member and having a plurality of foot-actuatable switch button means positioned thereon for controlling various pieces of electrical equipment on said boat.

5. The fishing boat platform as said forth in claim 1 wherein said chair is pivotable about a chair axis that is substantially parallel to said platform axis.

6. The fishing boat platform as set forth in claim 5 wherein said platform means further comprises means for rotating said platform means about said platform axis.

7. The fishing boat platform as set forth in claim 6 wherein said rotating means comprises an electric motor and control means therefor, said control means being mounted on said footrest member.

8. The fishing boat platform as set forth in claim 7 wherein said control means comprises a plurality of foot-actuatable switches mounted on an inclined portion of said footrest member.

9. The fishing boat platform as set forth in claim 8 wherein said footrest member includes means attached thereto for mounting auxiliary fishing instrumentation.

10. The fishing boat platform as set forth in claim 7 wherein said platform means further includes a control housing connected to the distal end of said base member and containing said electric motor and means connected thereto for driving said platform means about said platform axis.

11. The fishing boat platform as set forth in claim 10 wherein said chair includes a pivot post extending from the underside thereof and defining said chair axis.

12. The fishing boat platform as set forth in claim 11 wherein said control housing further includes a support sleeve extending therethrough for receiving said pivot post of said chair, said pivot post being freely pivotable pivotable within said support sleeve.

13. The fishing boat platform as set forth in claim 10 wherein said platform means further includes a vertical support member connected between said distal end of said base member and said control housing.

14. The fishing boat platform as set forth in claim 13 wherein said platform means further comprises a pair of triangular support gussets each of which is connected to adjoining edges of said base member and said vertical support member.

15. The fishing boat platform as set forth in claim 10 further comprising a pedestal fixedly mounted to said flat surface of said boat and having a longitudinal axis which coincides with said platform axis, said control housing being pivotally mounted about said pedestal.

16. The fishing boat platform as set forth in claim 15 wherein said drive means includes a drive shaft fixedly connectable to said pedestal, and a drive gear mounted on said drive shaft, said drive gear being driven by said electric motor.

17. The fishing boat platform as set forth in claim 16 wherein said pedestal includes shaft means formed therein for receiving said drive shaft which is coaxial with said platform axis.

18. A fishing boat platform which comprises:

platform means rotatably mounted with respect to a substantially flat surface of a boat;

a chair rotatable with respect to said platform means; and feet placement means positioned near an end of and rotatable with said platform means, said platform means being rotatable about a platform axis that is substantially perpendicular to said flat surface of said boat, said platform means including a base member upon one end of which is mounted said feet placement means, said feet placement means including a wedge-shaped member extending upwardly from said base member; and means attached to said placement means for mounting auxilliary fishing instrumentation in view of an individual seated on said chair.

* * * * *